US006779671B2

(12) United States Patent
Varga

(10) Patent No.: US 6,779,671 B2
(45) Date of Patent: Aug. 24, 2004

(54) SWIVEL BASED GARBAGE CAN CAROUSEL

(76) Inventor: Josephine Varga, 1746 Dakota St., Westfield, NJ (US) 07090

( * ) Notice: Subject to any disclaimer, the term of this patent is extended or adjusted under 35 U.S.C. 154(b) by 0 days.

(21) Appl. No.: 10/331,313

(22) Filed: Dec. 30, 2002

(65) Prior Publication Data

US 2004/0084393 A1 May 6, 2004

Related U.S. Application Data

(60) Provisional application No. 60/424,021, filed on Nov. 6, 2002.

(51) Int. Cl.[7] ..... A47F 5/00

(52) U.S. Cl. ..... 211/78; 211/163; 248/907

(58) Field of Search ..... 211/78, 163, 77; 248/907; 312/135, 249.2

(56) References Cited

U.S. PATENT DOCUMENTS 663,046 A * 12/1900 Schaeffer
860,019 A * 7/1907 Davis
2,513,630 A * 7/1950 Elliott
2,596,541 A * 5/1952 Farguharson
3,642,145 A * 2/1972 Shelton ..... 211/78
3,696,938 A * 10/1972 Sherman ..... 211/78
4,545,629 A * 10/1985 Hackett
5,580,015 A * 12/1996 Baker ..... 248/907 X
6,494,420 B2 * 12/2002 Luccero ..... 248/907 X

* cited by examiner

*Primary Examiner*—Robert W. Gibson, Jr.
(74) *Attorney, Agent, or Firm*—Walter J. Tencza, Jr.

(57) ABSTRACT

An apparatus is disclosed comprising a tray which is rotatably connected to a base. The tray can be comprised of a plurality of recesses, wherein each of the plurality of recesses is adapted to receive a corresponding one of a plurality of garbage cans. Each of the plurality of garbage cans can be placed in a corresponding recess so that when the tray is rotated with respect to the base, the position of any of the plurality of garbage cans with respect to the base changes. This allows easy access to the appropriate garbage can such as an open garbage can. One or more handles may be connected to the tray to help rotate the tray.

25 Claims, 5 Drawing Sheets

SWIVEL BASED GARBAGE CAN CAROUSEL

CROSS REFERENCE TO RELATED APPLICATIONS

The present application claims the priority of U.S. provisional application serial No. 60/424,021, inventor Josephine Varga, filed on Nov. 6, 2002.

FIELD OF THE INVENTION

This invention relates to methods and apparatus concerning garbage can storage, organization, and operation.

BACKGROUND OF THE INVENTION

Over the years, recycling has become a growing requirement. With this, comes the need to separate recyclables into garbage cans separate from other garbage. A typical example would be two garbage cans used specifically for recycling glass, cans and plastics. And two garbage cans used for every-day garbage disposal. As any one of the garbage cans become full, one finds himself moving garbage cans around to get to an empty one in the back. This can become very frustrating.

Homeowners today primarily use freestanding garbage cans. With the recycling requirements, many homes may use four or more garbage cans. This can become cumbersome and in inclement weather the situation can get even worse if the homeowner is faced with fallen garbage cans that have been taken by strong winds. Homeowners, often may have to retrieve garbage containers from the street after experiencing heavy winds.

SUMMARY OF THE INVENTION

The present invention in one or more embodiments provides an apparatus comprising a tray, which is rotatably connected to a base. The tray can be comprised of a plurality of recesses, wherein each of the plurality of recesses is adapted to receive a corresponding one of a plurality of garbage cans. Each of the plurality of garbage cans can be placed in a corresponding recess so that when the tray is rotated with respect to the base, the position of any of the plurality of garbage cans with respect to the base changes. Each of the plurality of recesses may have a diameter, which is about the same as a diameter of a body portion of a first garbage can of the plurality of garbage cans. Each of the plurality of garbage cans may be an approximately thirty-gallon garbage can.

First, second, third, and/or fourth handles may be connected to the tray. The tray can be rotated with respect to the base by moving the first, second, third, and/or fourth handles with respect to the base. The first, second, third, and/or fourth handles may be elongated members, each of which may have a length which is about the length of a garbage can.

The present invention in one embodiment includes a method comprising connecting a tray to a base in a manner which allows the tray to rotate with respect to the base; and placing one or more garbage cans into one or more corresponding recesses of the tray.

The present invention, in one or more embodiments, allows easy access to a plurality of garbage cans or containers. In one or more embodiments a swivel-based garbage can organizer permits both the storage and free turning of all containers or garbage cans. The user would be able to easily access any container and each container would also be supported by the garbage can swivel and guarded against tipping over in strong winds or other inclement weather conditions. This invention, in one or more embodiments, will not only allow for efficient, organized garbage disposal, it will also help to keep each container upright in inclement weather.

DETAILED DESCRIPTION OF THE DRAWINGS

Figure 1:
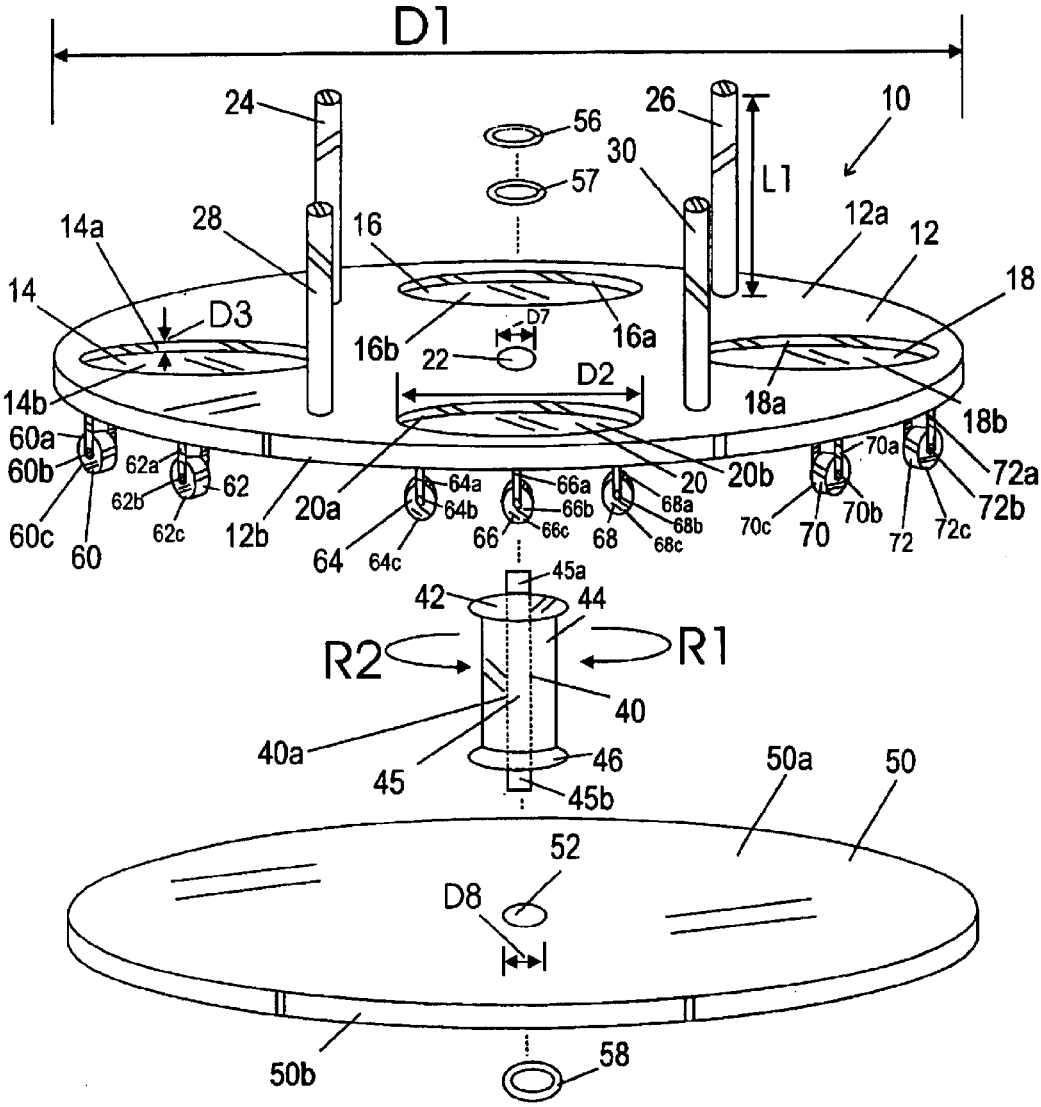
FIG. 1 shows a perspective exploded view of an apparatus in accordance with an embodiment of the present invention.

FIG. 1 shows a perspective exploded view of an apparatus 10 in accordance with an embodiment of the present invention. The apparatus 10 is comprised of a tray 12, handles 24, 26, 28, and 30 attached or fixed to the tray 12, a pin 40, and a base 50. The base 50 may be comprised of surface 50*a* and edge 50*b*. The base 50 may have an opening 52. The tray 12, handles 24, 26, 28, and 30 and the base 50 may be comprised of strong, lightweight, and rust proof material, such as for example, plastic, or polyvinyl chloride ("PVC").

The tray 12 is comprised of a top surface 12*a* and an edge 12*b*. The tray 12 may be substantially in the shape of a round circular disc with the exception of indentations or recesses 14, 16, 18, and 20, attachment devices, if any, for handles 24, 26, 28, and 30, and an opening 22. The opening 22 may be circular. The tray 12 may have a diameter of D1, which may be about five feet. The indentations or recesses 14, 16, 18, and 20 may be comprised of side walls 14*a*, 16*a*, 18*a*, and 20*a*, respectively. Each of the side walls 14*a*, 16*a*, 18*a*, and 20*a* may have a height of D3, which may be six inches. The height of the side walls 14*a*, 16*a*, 18*a*, and 20*a* may be considered to be the depth of the respective recesses 14, 16, 18, and 20. Thus the recesses may each have a depth of about six inches. The indentations or recesses 14, 16, 18, and 20 may also be comprised of floors or bases 14*b*, 16*b*, 18*b*, and 20*b*, respectively. The indentations 14, 16, 18, and 20 may each have a diameter of D2, which may be about two feet. The handles 24, 26, 28, and 30 may be fixed to the tray 12 by glue, by screws, or in any other manner. Each of the handles 24, 26, 28, and 30 may be an elongated member such as an elongated solid cylindrical metal or wooden pole or bar. Each of the handles 24, 26, 28, and 30 may have a length L1, shown in FIG. 1, which may be approximately equal to the length L2, shown in FIG. 2, of the garbage can 100.

Figure 4:
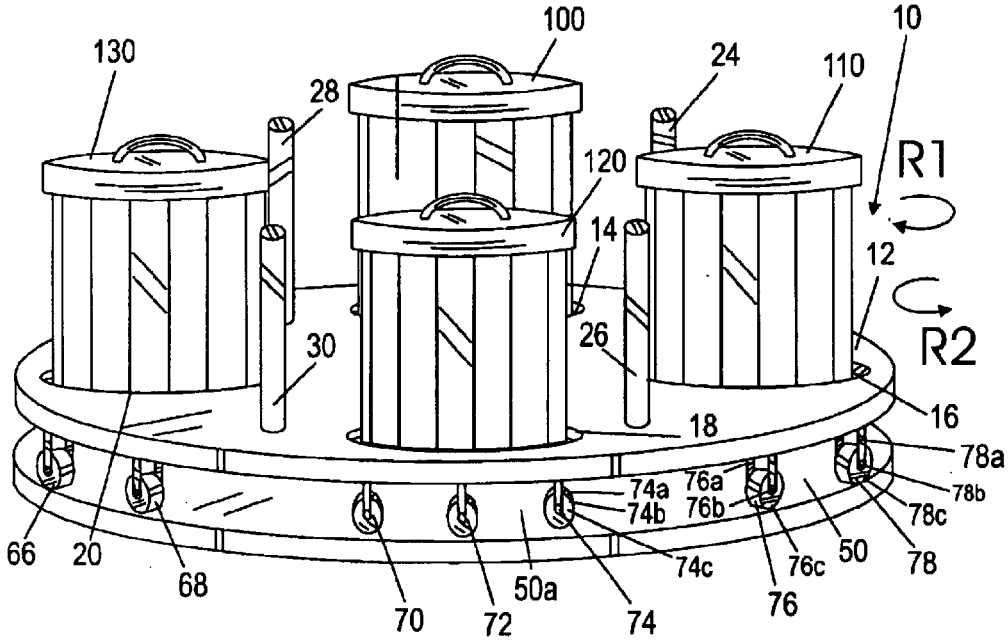
FIG. 4 shows the positions of the garbage cans of FIG. 3 when the assembled apparatus of FIG. 1 has been placed in a second rotational state.

The tray 12 may include, or may have attached or fixed thereto, wheel devices 60, 62, 64, 66, 68, 70, and 72 shown in FIG. 1 and wheel devices 74, 76, and 78 shown in FIG. 4. Two further wheel devices, not shown, may be attached to tray 12. Any number of wheel devices similar to those shown may be attached to a bottom surface 12*c* of the tray 12. The wheel devices may be attached or fixed to the bottom surface 12*c* at or near the undersides of the indentations 14, 16, 18, and 20. Wheel devices 60, 62, and a further wheel device may be fixed to the bottom surface 12*c* at or near the underside of indentation 14. Wheel devices 64, 66, and 68 may be fixed to the bottom surface 12*c* at or near the underside of indentation 20. Wheel devices 70, 72, and 74 may be fixed to the bottom surface 12*c* at or near the underside of indentation 18. Wheel devices 76, 78, and a further wheel device not shown may be fixed to the bottom surface 12*c* at or near the underside of indentation 16. The wheel devices 60, 62, 64, 66, 68, 70, 72, 74, 76, and 78 include brackets 60*a*, 62*a*, 64*a*, 66*a*, 68*a*, 70*a*, 72*a*, 74*a*, 76*a*, and 78*a*, respectively, which are fixed to the bottom surface 12*c*, axels 60*b*, 62*b*, 64*b*, 66*b*, 68*b*, 70*b*, 72*b*, 74*b*, 76*b*, and 78*b*, respectively, and wheels 60*c*, 62*c*, 64*c*, 66*c*, 68*c*, 70*c*, 72*c*, 74*c*, 76*c*, and 78*c*, respectively.

The pin 40 may be comprised of portions 42, 44, and 46. The portion 44 may be a cylinder with a diameter of about six inches. The pin 40 may have a hole 40*a* bored through its center. A cylindrical rod 45 may be inserted into the hole 40*a*. The cylindrical rod 45 is partially shown in pin 40 by dashed lines in FIG. 1, and partially shown protruding out of pin 40 at ends 45*a* and 45*b*, and the rod has a diameter of ½ to one inch. The hole 40*a* may have a diameter slightly larger than the rod 45. The rod 45 may be comprised of aluminum or other rust proof material. One end 45*b* of the cylindrical rod 45 may be threaded and may be inserted through opening 52 of the base 50. The opening 52 may be circular and may have a diameter of D8, which may be slightly greater than the diameter of the rod 45. A lock nut 58, adapted to screw onto end 45*b*, can be screwed onto the end 45*b* to fix the rod 45 and the pin 40 to the base 50. Another end 45*a* of the rod 45 can be inserted through the hole 22 of the tray 12 and thereafter firstly a thrust bearing 57 and lastly a lock nut 56, both adapted to screw onto end 45*a*, can be screwed onto the end 45*a* to fix the rod 45 and the pin 40 to the tray 12. The hole 22 may be circular and may have a diameter of D7 which may be the same as the diameter D8 of the base opening 52. The top portion 42 of the pin may be cylindrical and may have a diameter larger than the opening 22, so that the tray 12 rests on the top portion 42. Similarly the bottom portion 46 of the pin 40 may be cylindrical and may have a diameter which is greater than the diameter D8 of the opening 52. The pin 40 provides sufficient spacing to allow the wheel devices 60, 62, 64, 66, 68, 70, 72, 74, 76, and 78, and two further wheel devices not shown, to fit between the tray 12 and the base 50 after assembly and during normal operation as shown by FIGS. 3 and 4.

Figure 2:
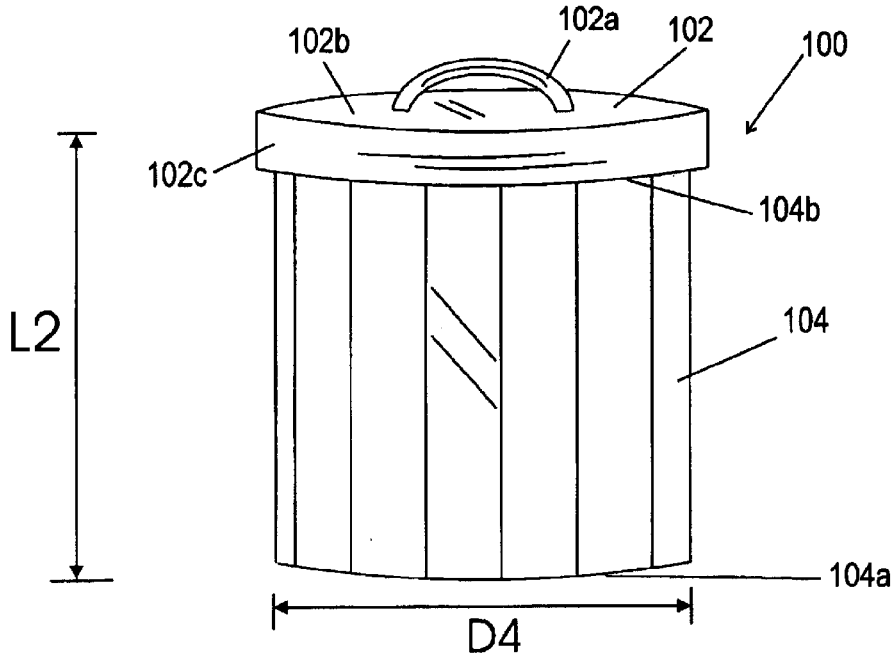
FIG. 2 shows a perspective view of a prior art garbage can.

FIG. 2 shows a perspective view of a prior art garbage can 100. The garbage can 100 may be a standard thirty gallon garbage can. The garbage can 100 is comprised of a top portion or lid 102 and a body portion 104. The lid 102 is comprised of a handle 102*a*, a top surface 102*b*, and a side surface or edge 102*c*. The body portion 104 has a diameter D4 at the bottom 104*a* of the body 104. The diameter D4 may increase going upwards towards the top 104*b* of the body portion 104.

Figure 3:
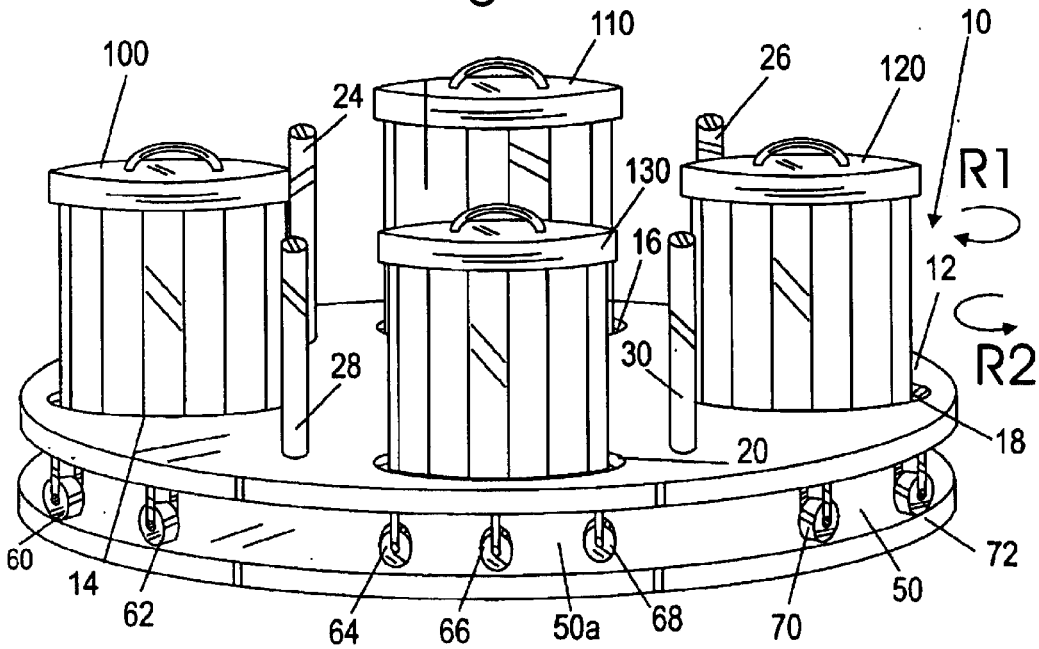
FIG. 3 shows an assembled perspective view of the apparatus of FIG. 1, with a plurality of garbage cans similar or the same as the garbage can in FIG. 2, placed in the apparatus of FIG. 1.

FIG. 3 shows an assembled perspective view of the apparatus 10 of FIG. 1, with a plurality of garbage cans 100, 110, 120, and 130 similar or the same as the garbage can 100 in FIG. 2, placed in the assembled apparatus 10. Each of the garbage cans 100, 110, 120, and 130 is placed in an indentation of the tray 12. Garbage cans 100, 110, 120, and 130 are placed in indentations 14, 16, 18, and 20, respectively. The indentations 14, 16, 18, and 20 have a diameter D2 which in one embodiment, is slightly larger than the diameter D4 at the bottom 104*a* of the body portion 104 of the garbage can 100. This allows the garbage can 100 to be inserted into the indentation 14 as shown by FIG. 3, and also allows the garbage can 100 to be held fairly tightly by the inner wall 14*b* of the indentation 14. Similarly garbage cans 110, 120, and 130 can be inserted into indentations 16, 18, and 20 and also can be held fairly tightly by the inner walls 16*b*, 18*b*, and 20*b*, respectively.

The apparatus 10 can be assembled by first inserting the 60*c*, portion 46 of the pin 40 into the opening 52 of the base 50. Next, the opening 22 of the tray 12 can be placed over the portion 42 of the pin 40. The tray 12, in this embodiment, lies on top of and concentric with base 40 when the tray 12 is rotatably connected to the base 50 as in FIG. 3. When the tray 12, pin 40 and base 50 have been assembled as in FIG. 3, the tray 12 can rotate in either the clockwise direction of R1 or in the counterclockwise direction of R2 with respect to the base 50.

After the apparatus 10 has been assembled the garbage cans 100, 110, 120, and 130 can be inserted into the indentations 14, 16, 18, and 20, respectively, as shown by FIG. 3. Any one or any combination of the handles 24, 26, 28, and 30 can be used to hold rotate the tray 12 with respect to the base 50.

FIG. 3 shows the positions of the garbage cans 100, 110, 120, and 130 when the tray 12 is at a first rotational position or in a first rotational state with respect to the base 50. FIG. 4 shows the positions of the garbage cans 100, 110, 120, and 130 when the tray 12 is at a second rotational position or in a second rotational state with respect to the base 50. In FIG. 3 garbage can 100 and indentation 14 are shown on the left side of the page, garbage can 110 and indentation 16 are shown on the top center of the page, garbage can 130 and indentation 20 are shown on the bottom center of the page, and garbage can 120 and indentation 18 are shown on the right side of the page. In FIG. 4 after rotation of the tray 12 in a clockwise direction R1, garbage can 100 and indentation 14 are now shown at the top center of the page, garbage can 110 and indentation 16 are now shown on the right side of the page, garbage can 120 and indentation 18 are now shown at the bottom center of the page, and garbage can 130 and indentation 20 are now shown on the left side of the page. The rotation of the tray 12 allows one to access a garbage can more easily after one of the garbage cans 100, 110, 120, and 130 has become full. For example, assuming a person would be closest to garbage can 130 in the position of FIG. 3, after the garbage can 130 becomes full, rotation of the tray 12 allows the person to access garbage can 120, which in this example would be empty. After garbage can 120 becomes full, the person can rotate the tray 12 again in the clockwise direction to access garbage can 110, which in this example would be empty. The present invention in this embodiment thus avoids having to climb over a full garbage can to access and empty one and avoids heavy lifting garbage cans and their contents.

The wheels 60*c*, 62*c*, 64*c*, 66*c*, 68*c*, 70*c*, 72*c*, 74*c*, 76*c*, and 78*c*, after assembly as in FIG. 3, contact the surface 50*a* of the base 50. The wheels 62*c*, 64*c*, 66*c*, 68*c*, 70*c*, 72*c*, 74*c*, 76*c*, and 78*c*, and the wheel devices 62, 64, 66, 68, 70, 72, 74, 76, and 78 along with pin assembly 40 bear the load of the tray 12 and the garbage cans 100, 110, 120, and 130. The wheels 60*c*, 62*c*, 64*c*, 66*c*, 68*c*, 70*c*, 72*c*, 74*c*, 76*c*, and 78*c* can rotate about their respective axel or axis 60*b*, 62*b*, 64*b*, 66*b*, 68*b*, 70*b*, 72*b*, 74*b*, 76*b*, and 78*b*. When the tray 12 is rotated from the position shown in FIG. 3 to the position shown in FIG. 4, the wheels 60*c*, 62*c*, 64*c*, 66*c*, 68*c*, 70*c*, 72*c*, 74*c*, 76*c*, and 78*c*, and two further wheels not shown, will rotate to allow the tray to easily move with respect to the base 50. Without the wheels 60*c*, 62*c*, 64*c*, 66*c*, 68*c*, 70*c*, 72*c*, 74*c*, 76*c*, and 78*c*, and two further wheels not shown, or at least some wheels or some other mechanism, the bottom surface 12*c* of the tray 12 would rub against the top surface 50*a* of the base 50, and this would make it difficult to rotate the tray 12 with respect to the base 50.

The wheels devices 60, 62, 64, 66, 68, 70, 72, 74, 76, and 78, and two further wheel devices not shown may swivel with respect to the tray 12 or the wheels devices 60, 62, 64, 66, 68, 70, 72, 74, 76, and 78, and two further wheel devices may be locked into a certain position so that the wheels 60*c*, 62*c*, 64*c*, 66*c*, 68*c*, 70*c*, 72*c*, 74*c*, 76*c*, and 78*c*, and two further wheel will rotate when the tray 12 is rotated. Each wheel may be allowed to rotate but may be fixed in a direction so that the outer surface of the wheel, such as outer surface 66*d*, is parallel to a straight line tangential to a circular curve defined by the edge 50*b* of the base 50.

Figure 5:
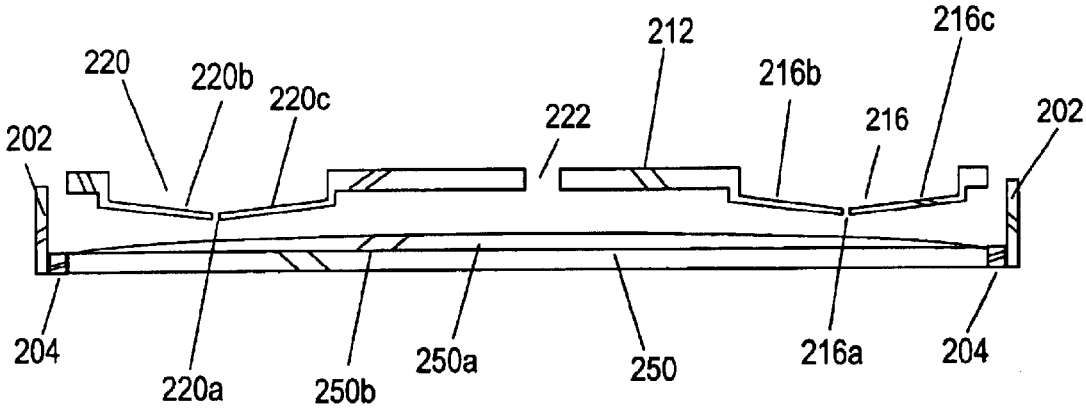
FIG. 5 shows a cross sectional view of a tray and a base for use with another embodiment of the present invention.
Figure 6:
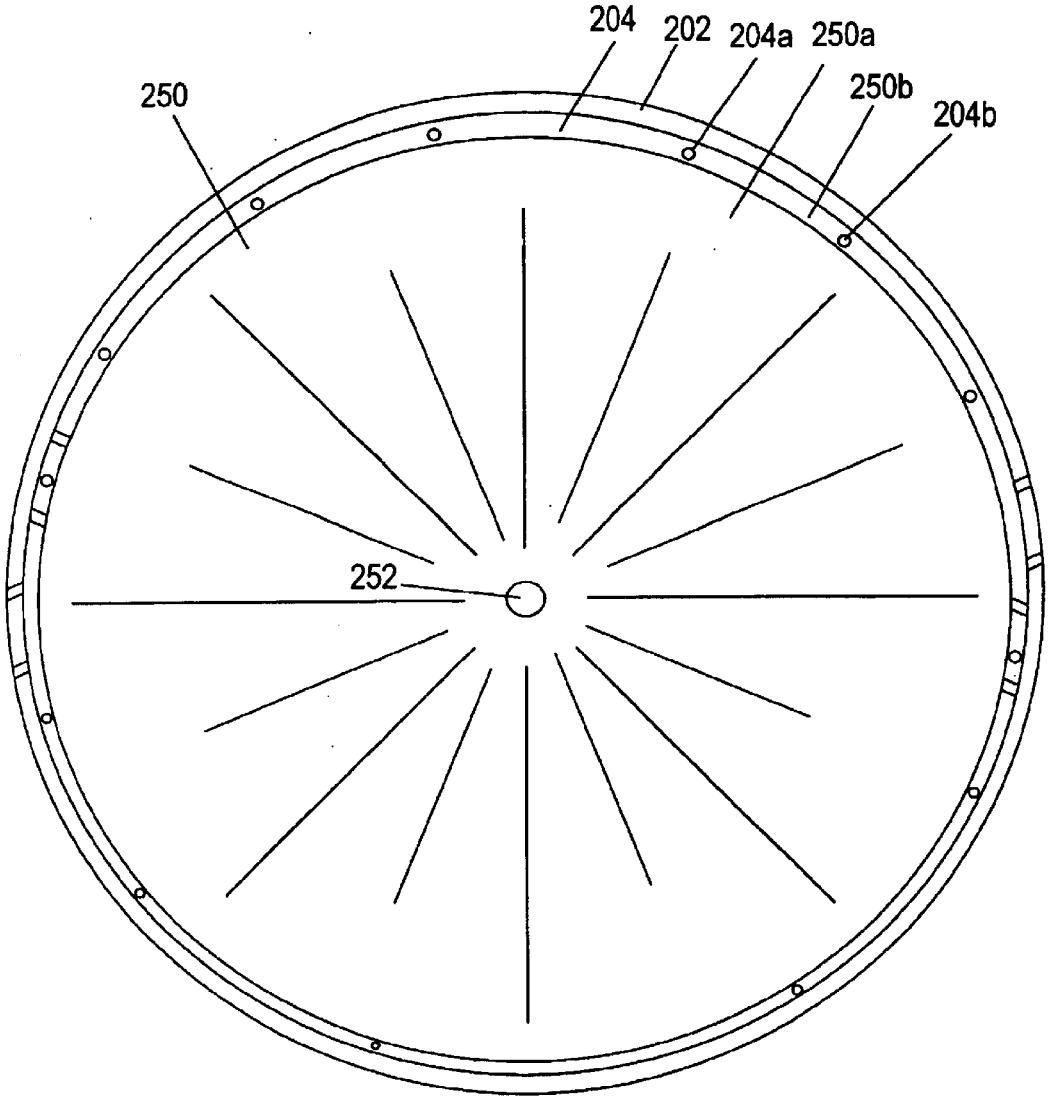
FIG. 6 shows a top view of the base of FIG. 5.
Figure 7:
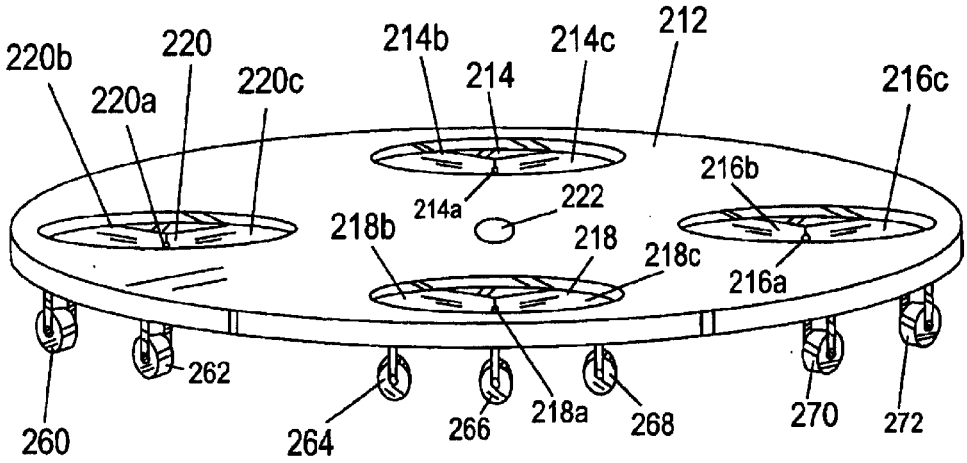
FIG. 7 shows a perspective view of the tray of FIG. 5 and with attached wheel devices.
Figure 8:
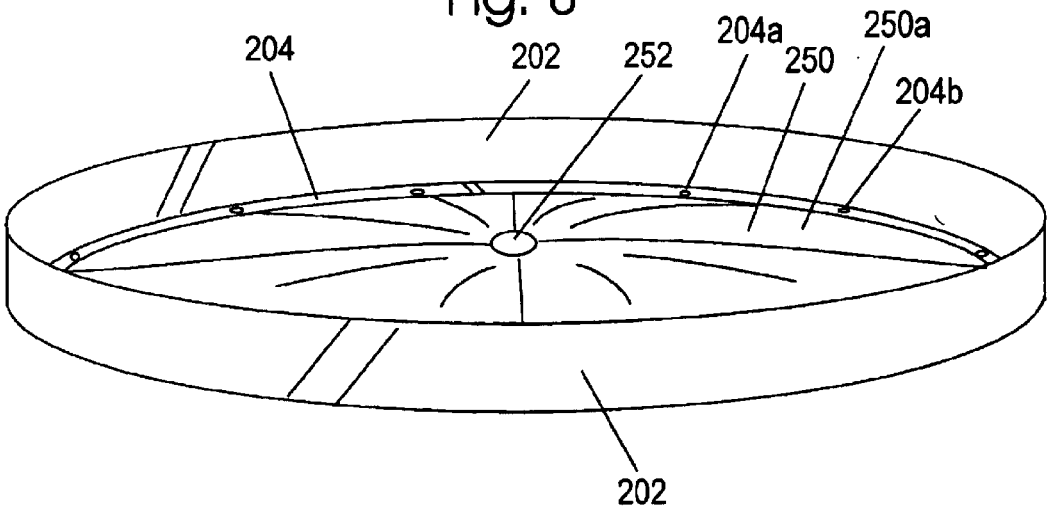
FIG. 8 shows a perspective view of the base of FIG. 5.

FIG. 5 shows a cross sectional view of a tray 212 (with wheel devices omitted for simplification) and a base 250 for use with another embodiment of the present invention. FIG. 6 shows a top view of the base 250 of FIG. 5. FIG. 7 shows a perspective view of the tray 212 of FIG. 5 and with attached wheel devices 260, 262, 264, 266, 268, 270, and 272. FIG. 8 shows a perspective view of the base 250 of FIG. 5.

The tray 212 may be similar to the tray 12 except as will be described. The tray 212 has indentations 214, 216, 218, and 220 shown by FIGS. 5 and 7 which are the same as the indentations 14, 16, 18, and 20, respectively, except that the indentations 14, 16, 18, and 20 have flat surfaces 14*b*, 16*b*, 18*b*, and 20*b* and no holes, while the indentations 214, 216, 218, and 220, have surfaces which slope downwards towards the base 250 and have an opening or hole at the bottom of the respective indentation. For example, as shown by FIGS. 5 and 7, indentation 214 has inner surfaces 214*b* and 214*c*, which funnel or slope downwards towards the opening 214*a*. Similarly indentation 216 has inner surfaces 216*b* and 216*c*, which funnel or slope downwards towards the opening 216*a*, indentation 218 has inner surfaces 218*b* and 218*c*, which funnel or slope downwards towards the opening 218*a*, and indentation 220 has inner surfaces 220*b* and 220*c*, which funnel or slope downwards towards the opening 220*a*. The purpose of the funnels or sloping surfaces is to drain any water that may accumulate in the indentations 214, 216, 218, or 220. The tray 212 would typically have handles similar or the same as handles 24, 26, 28, and 30, however handles have been left out of FIG. 5 and FIG. 7 for simplification of description.

The base 250 in FIGS. 5, 6, and 8 is similar to the base 50 of FIG. 1, except that the base 250 has a concave surface 250*a* as shown by FIG. 5 and FIG. 8, and the base 250 is attached to a protective wall 202 by a member 204. The member 204 may be circular and may have a plurality of openings such as opening 204*a* and 204*b*. When water falls through the openings 214*a*, 216*a*, 218*a*, and 220*a* of the indentations 214, 216, 218, and 220, respectively, it falls onto the surface 250*a* of the base 250 and is directed, as a result of the concave surface 250*a* to the member 204. The water falls through the openings, such as openings 204*a* and 204*b*, to allow for drainage of the indentations 214, 216, 218, and 220.

The protective wall 202 may encircle the base 250 and prevent leaves, debris, or animals from going between the tray 212 and the base 250. The tray 212 and the base 250 can be connected to one another, in the same manner as tray 12 and base 50. Wheel devices 260, 262, 264, 266, 268, 270, and 272, as well as five further wheel devices (three for each of indentations 214, 216, 218, and 220) similar or the same as wheel devices shown in FIGS. 1, 3, and 4 can be attached to the tray 212, and are omitted in FIG. 5 merely to simplify description. The garbage cans 100, 110, 120, and 130 can be inserted into indentations 214, 216, 218, and 220, respectively. The pin 40 along with the other related components in FIG. 1 can also be used to connect the tray 212 with the base 250 to allow the tray 212 to rotate with respect to the base 250. The member 204, in addition to being used for drainage, is used to space the protective wall 202 from the tray 212, as shown in FIG. 5, so that the tray 212 can rotate freely without contacting the wall 202. Also the spacing by member 204 prevents the wheel devices, such as wheel devices 260, 262, 264, 266, 268, 270, and 272 from contacting the protective wall so that the tray 212 can rotate freely. The base 250 has a centrally located opening 252 and the tray 212 has a centrally located opening 222 for connecting the base 250 to the tray 212.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a tray comprised of a plurality of recesses, where each of the plurality of recesses is adapted to receive a corresponding one of a plurality of garbage cans; and a base;

wherein the tray is connected to the base in a manner which allows the tray to rotate with respect to the base; and wherein when a first garbage can of the plurality of garbage cans is placed in a first recess of the plurality of recesses, and when the tray is rotated with respect to the base, the position of the first garbage can with respect to the base changes; and further comprising a plurality of wheel devices fixed to a bottom surface of the tray;

wherein the plurality of wheel devices have a corresponding plurality of wheels which rotate when the tray is rotated with respect to the base.

2. The apparatus of claim 1 wherein each of the plurality of recesses has a diameter which is about the same as a diameter of a body portion of the first garbage can.

3. The apparatus of claim 2 wherein the first garbage is an approximately thirty gallon garbage can.

4. The apparatus of claim 1 wherein each of the plurality of recesses has a depth of about six inches.

5. The apparatus of claim 1 wherein there is at least one wheel device fixed near each recess of the tray.

6. The apparatus of claim 1 wherein the plurality of wheels come in contact with and roll on the base.

7. The apparatus of claim 1 wherein the base is concave.

8. The apparatus of claim 7 wherein the base is connected to a member having a plurality of openings; and wherein water can drain from the base and through the openings of the member.

9. The apparatus of claim 1 further comprising a protective wall which encircles the base.

10. An apparatus comprising:

a tray comprised of a plurality of recesses, where each of the plurality of recesses is adapted to receive a corresponding one of a plurality of garbage cans; and a base;

wherein the tray is connected to the base in a manner which allows the tray to rotate with respect to the base; and wherein when a first garbage can of the plurality of garbage cans is placed in a first recess of the plurality of recesses, and when the tray is rotated with respect to the base, the position of the first garbage can with respect to the base changes; and further comprising a first handle connected to the tray; and wherein the tray can be rotated with respect to the base by moving the first handle with respect to the base.

11. The apparatus of claim 10 further comprising second, third, and fourth handles connected to the tray; and wherein the tray can be rotated with respect to the base by moving any one of the second, third, or fourth handles with respect to the base.

12. The apparatus of claim 10 wherein the first handle is an elongated member.

13. The apparatus of claim 12 wherein the first handle has a length which is about the length of the first garbage can.

14. The apparatus of claim 13 further comprising second, third, and fourth handles connected to the tray; and wherein the second, third, and fourth handles are elongated members.

15. The apparatus of claim 14 wherein each of the second, third, and fourth handles has a length which is about the length of the first garbage can.

16. A method comprising:

connecting a tray to a base in a manner which allows the tray to rotate with respect to the base; and placing a first garbage can into a first recess of the tray; and further comprising fixing a plurality of wheel devices to a bottom surface of the tray, wherein the plurality of wheel devices have a plurality of corresponding wheels, and wherein the plurality of wheel devices are fixed so that when the tray is rotated with respect to the base, the plurality of corresponding wheels rotate.

17. The method of claim 16 wherein the first recess of the tray is adapted to have a diameter which is about the same as a diameter of a body portion of the first garbage can.

18. The method of claim 16 further comprising placing a second garbage can into a second recess of the tray.

19. The method of claim 18 wherein the first recess of the tray is adapted to have a diameter which is about the same as a diameter of a body portion of the first garbage can; and the second recess of the tray is adapted to have a diameter which is about the same as a diameter of a body portion of the second garbage can.

20. The method of claim 16 wherein the first garbage is an approximately thirty gallon garbage can.

21. The method of claim 18 wherein the first garbage can is an approximately thirty gallon garbage can; and the second garbage can is an approximately thirty gallon garbage can.

22. A method comprising:

connecting a tray to a base in a manner which allows the tray to rotate with respect to the base; and placing a first garbage can into a first recess of the tray; and further comprising connecting a first handle to the tray; and wherein the tray can be rotated with respect to the base by moving the first handle with respect to the base.

23. The method of claim 22 further comprising connecting second, third, and fourth handles to the tray; and wherein the tray can be rotated with respect to the base by moving any one of the second, third, or fourth handles with respect to the base.

24. The method of claim 22 wherein the first handle is an elongated member.

25. The method of claim 24 wherein the first handle has a length which is about the length of the first garbage can.

* * * * *